US007223109B1

(12) United States Patent
Cors

(10) Patent No.: US 7,223,109 B1
(45) Date of Patent: May 29, 2007

(54) REPLACEMENT RJ45 LATCH

(75) Inventor: Josep Cors, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/470,855

(22) Filed: Sep. 7, 2006

(51) Int. Cl.
*H01R 13/44* (2006.01)

(52) U.S. Cl. ..... 439/144; 439/638

(58) Field of Classification Search ..... 439/344, 439/353, 354, 357, 595, 638, 676
See application file for complete search history.

(56) References Cited

U.S. PATENT DOCUMENTS 1,839,867 A * 1/1932 Crimmins ..... 445/73
3,219,961 A * 11/1965 Bailey et al. ..... 439/354
5,222,897 A * 6/1993 Collins et al. ..... 439/157
6,171,120 B1 * 1/2001 Bolich et al. ..... 439/157
2006/0046575 A1 * 3/2006 Allen ..... 439/638

* cited by examiner

*Primary Examiner*—James Harvey
*Assistant Examiner*—Travis Chambers
(74) *Attorney, Agent, or Firm*—Dillon & Yudell

(57) ABSTRACT

A replacement latch for a male RJ45 plug is presented. The replacement latch includes a housing and a latch within the housing, wherein the latch includes: a substantially U-shaped component having a middle section that joins a first arm of the U-shaped component to a second arm of the U-shaped component, wherein the first arm terminates at a first arm end that has a shape that is geometrically similar to a standard RJ45 retention protrusion, and wherein the middle section is rotatable about a pivot point that is inside the housing, and a horizontal activator having a depressor that is in sliding contact with the second arm, wherein a horizontal movement, in a first direction, of the horizontal activator causes the middle section to rotate about the pivot point to cause the first arm end to engage against a retention lip in a female RJ45 receptacle.

9 Claims, 5 Drawing Sheets

REPLACEMENT RJ45 LATCH

BACKGROUND OF THE INVENTION

The present invention relates in general to the field of computers and hardware used in computer networks. More particularly, the present invention relates to a replacement latch for a male RJ45 connection plug.

While early computers were often stand-alone machines, modern computers are usually connected to some type of network in order to share resources. Examples of such networks include the Internet, Wide Area Networks (WANs) and Local Area Networks (LANs). In order to tap into a network such as a LAN, a client computer must be coupled to the LAN either wirelessly (e.g., via an 802.11x router) or through hard wiring. A popular hard wiring system utilizes connectors known as RJ45 connectors.

Referring to FIG. 1*a*, a LAN 100 is depicted. A client computer 102 has a cable 104 that terminates at a male RJ45 plug 106. The male RJ45 plug 106 couples with a female RJ45 receptacle 108, which is coupled to a LAN 110 via cabling 112. Details of how male RJ45 plug 106 and female RJ45 receptacle 108 mate are shown in FIG. 1*b*. As depicted, male RJ45 plug 106 includes an RJ45 molded flexible latch 114, which has an RJ45 retention protrusion 116. This RJ45 retention protrusion 116 engages against a female RJ45 retention lip 118, thus securely pressing pins 120 in the male RJ45 plug 104 against corresponding contacts 122 in the female RJ45 receptacle 108. This system works well except when the RJ45 molded flexible latch 114 breaks, which often happens when the RJ45 molded flexible latch 114 is accidentally caught against wiring and other fixed objects. To replace the male RJ45 plug 106 is extremely difficult, due to the very fine gauge of wires leading from cable 104 to pins 120. Due to the difficulty in repairing a cable 104 with a broken RJ45 molded flexible latch 114, the entire cable 104 is usually thrown away and replaced with a new cable, which is expensive.

SUMMARY OF THE INVENTION

To address the above-described problem, the present invention provides a replacement latch for a male RJ45 plug. In one embodiment, the replacement latch comprises a housing; and a latch within the housing, wherein the latch includes: a substantially U-shaped component having a middle section that joins a first arm of the U-shaped component to a second arm of the U-shaped component, wherein the first arm terminates at a first arm end that has a shape that is geometrically similar to a standard RJ45 retention protrusion, and wherein the middle section is rotatable about a pivot point that is inside the housing, and a horizontal activator having a depressor that is in sliding contact with the second arm, wherein a horizontal movement, in a first direction, of the horizontal activator causes the depressor to push against an inclined surface of the second arm, such that the middle section rotates about the pivot point to cause the first arm end to engage against a retention lip in a female RJ45 receptacle. The replacement latch may further include latching grooves on both an actuator channel surface in the housing and an activator surface on the horizontal activator, wherein the latching grooves provide frictional retention against the horizontal activator to keep the first arm end engaged against the retention lip in the female RJ45 receptacle. In one embodiment, the horizontal activator has a handle end that is always outside the housing, and wherein the horizontal activator has a depressor end that is always inside the housing, and wherein a horizontal movement, in a second direction that is opposite the first direction, of the horizontal activator causes the horizontal activator to push against the middle section of the U-shaped component, thus resulting in the first arm end disengaging away from the retention lip of the female RJ45 receptacle.

The replacement latch can be securely clipped to an existing male RJ45 plug, preferably by snapping together a top and bottom component of the housing around the existing male RJ45 plug. The male RJ45 plug is now able, once again, to securely mate with a female RJ45 receptacle.

In one embodiment, the replacement latch is used to repair an RJ45 cable, which is used to connect a computer with a Local Area Network (LAN).

The above, as well as additional purposes, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further purposes and advantages thereof, will best be understood by reference to the following detailed description of an illustrative embodiment when read in conjunction with the accompanying drawings, where:

DETAILED DESCRIPTION OF THE PREFERRED EMBODIMENT

Figure 2A:
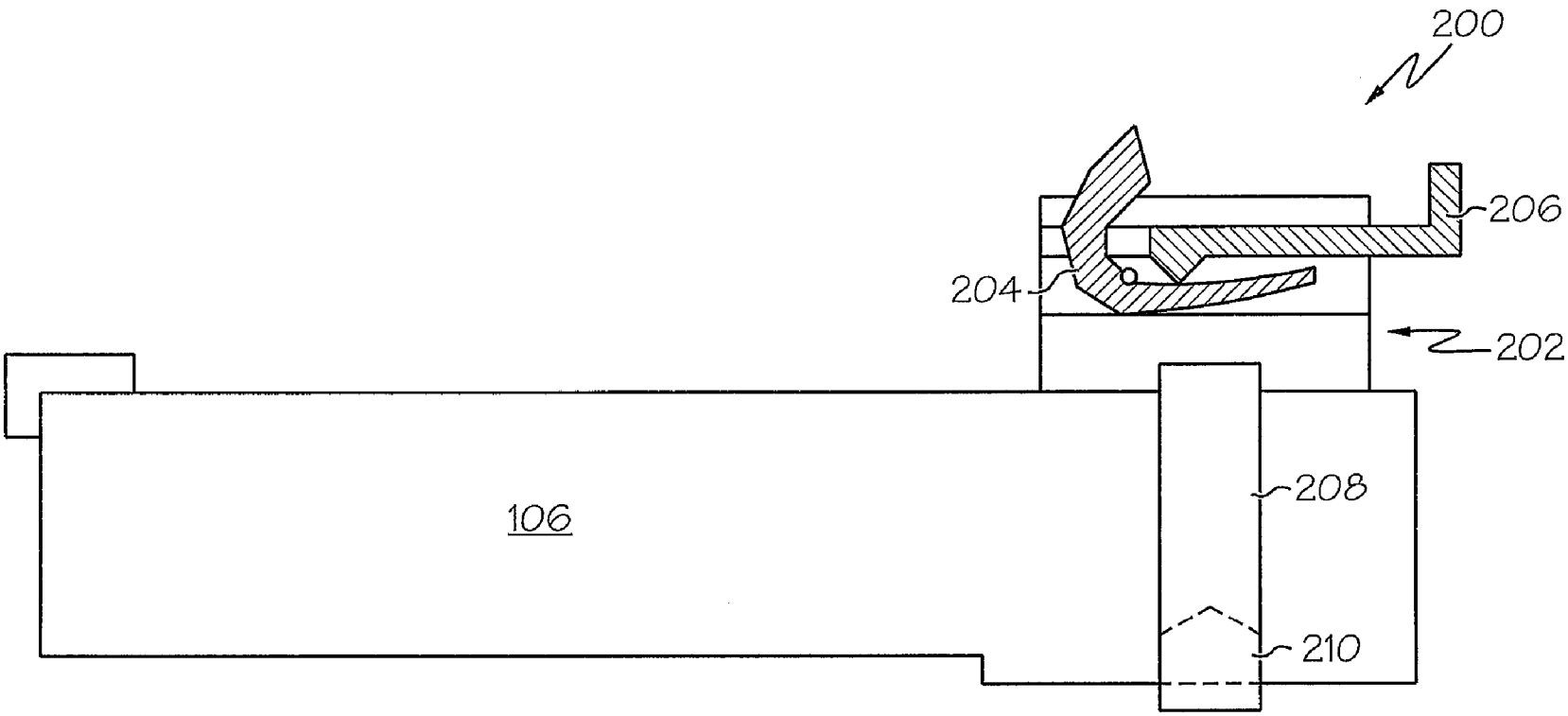
FIGS. 2*a–c* depict an inventive replacement latch for the male RJ45 plug shown in FIGS. 1*a–b*.

With reference now to FIG. 2*a*, there is depicted a block diagram of a replacement latch 200 as contemplated for use with a cable having a male RJ45 plug 106 whose original molded flexible latch 114 has been broken off. As depicted, replacement latch 200 is preferably secured to the old male RJ45 plug 106 by clipping a clip latch 208, which is part of the replacement latch 200, to an existing cable clamp indentation 210 in male RJ45 plug 106. The clip latch 208 holds a housing 202 securely against the old male RJ45 plug 106. Movably secured within the housing 202 is a substantially U-shaped (or "banana shaped") component 204 and a horizontal activator 206. As described in further detail below, when horizontal activator 206 is manually pushed to the left (as depicted in exemplary FIG. 2*c*), the U-shaped component 204 rotates in a counter-clockwise motion. When horizontal activator 206 is manually pushed to the right, then the U-shaped component 204 rotates in a clockwise motion.

Figure 2B:
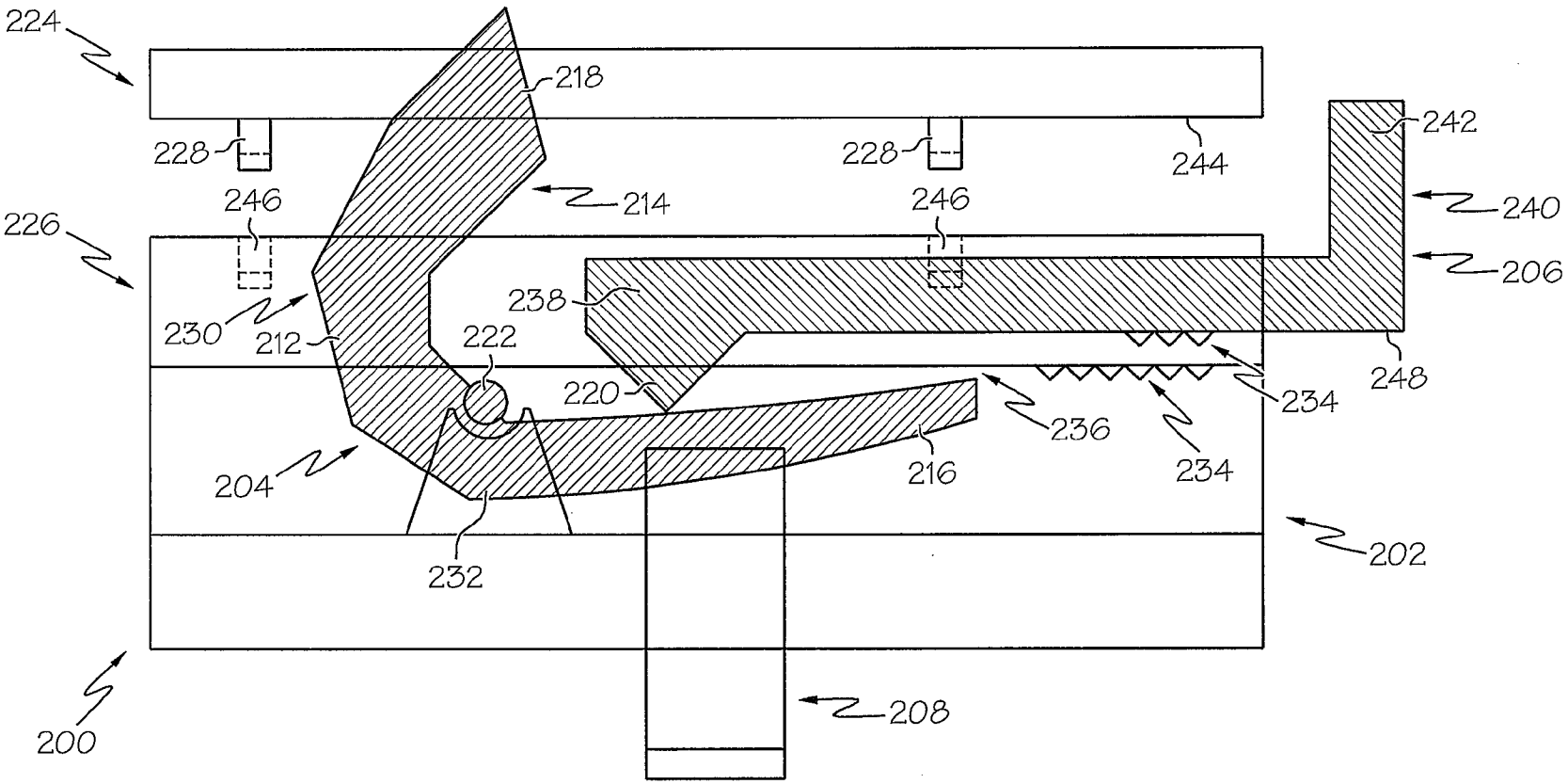

Referring now to FIG. 2*b*, additional detail for replacement latch 200 is presented. First, note that housing 202 is made up of two components: a cover 224 and a base 226, which snap together when cover latches 228 mate with recesses 246. When the cover 224 and base 226 are snapped together, they form an activator channel 230 between a linear actuator top rail 244 and a linear actuator bottom rail 236 (which is an interior surface of housing 202), thus providing a passageway for the linear movement of horizontal activator 206.

Figure 1A:
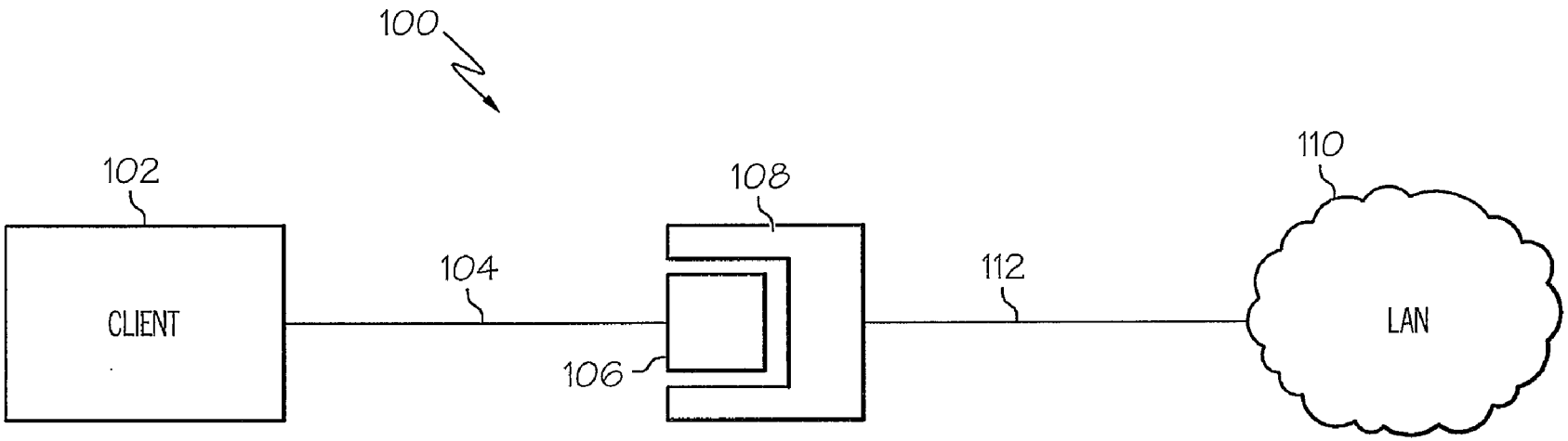
FIG. 1A (PRIOR ART)
FIG. 1*a* depicts an exemplary Local Area Network (LAN) that uses RJ45 connectors.
Figure 1B:
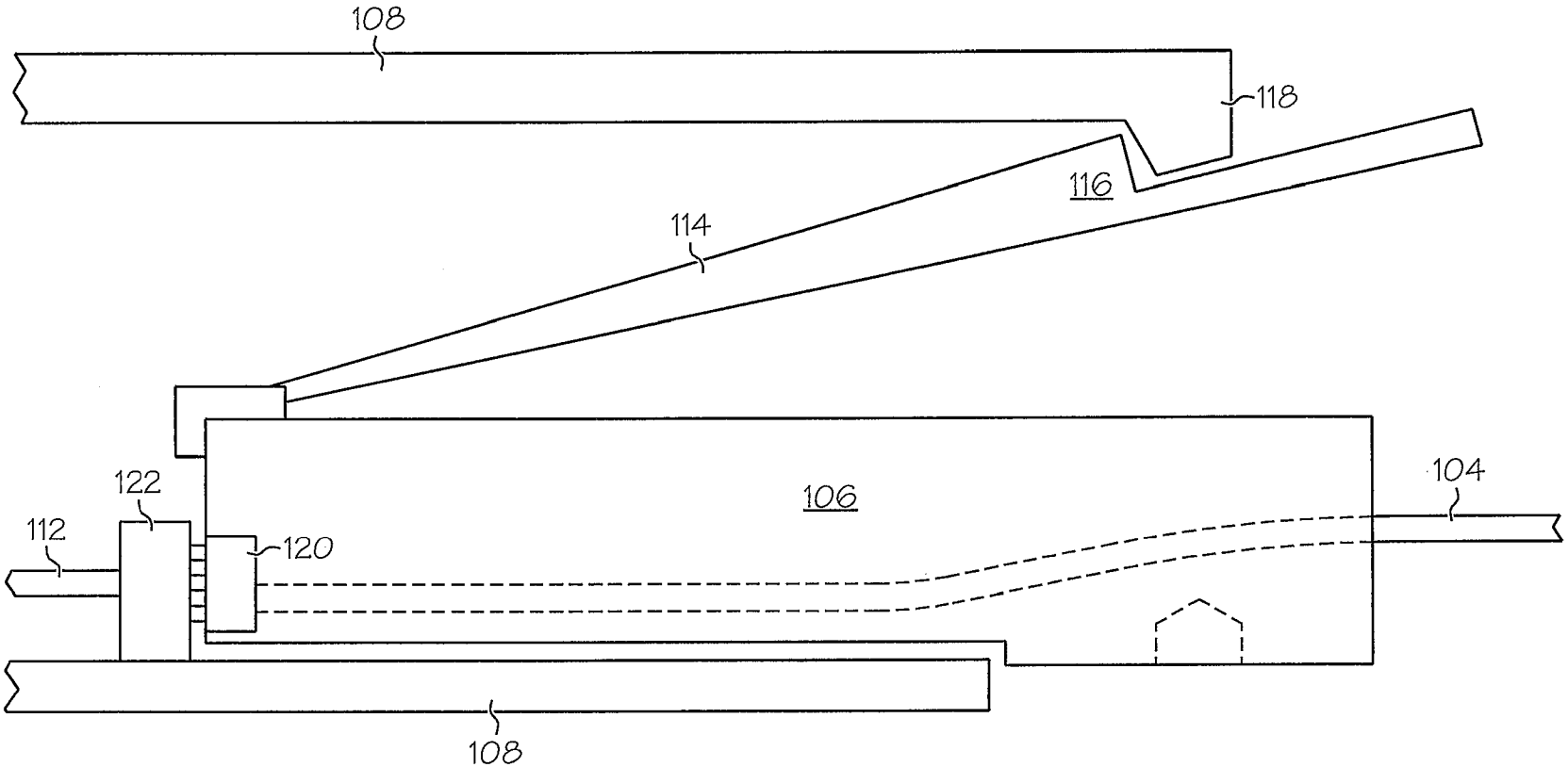
FIG. 1B (PRIOR ART)
FIG. 1*b* illustrates a prior art male RJ45 plug with a molded flexible latch.
Figure 2C:
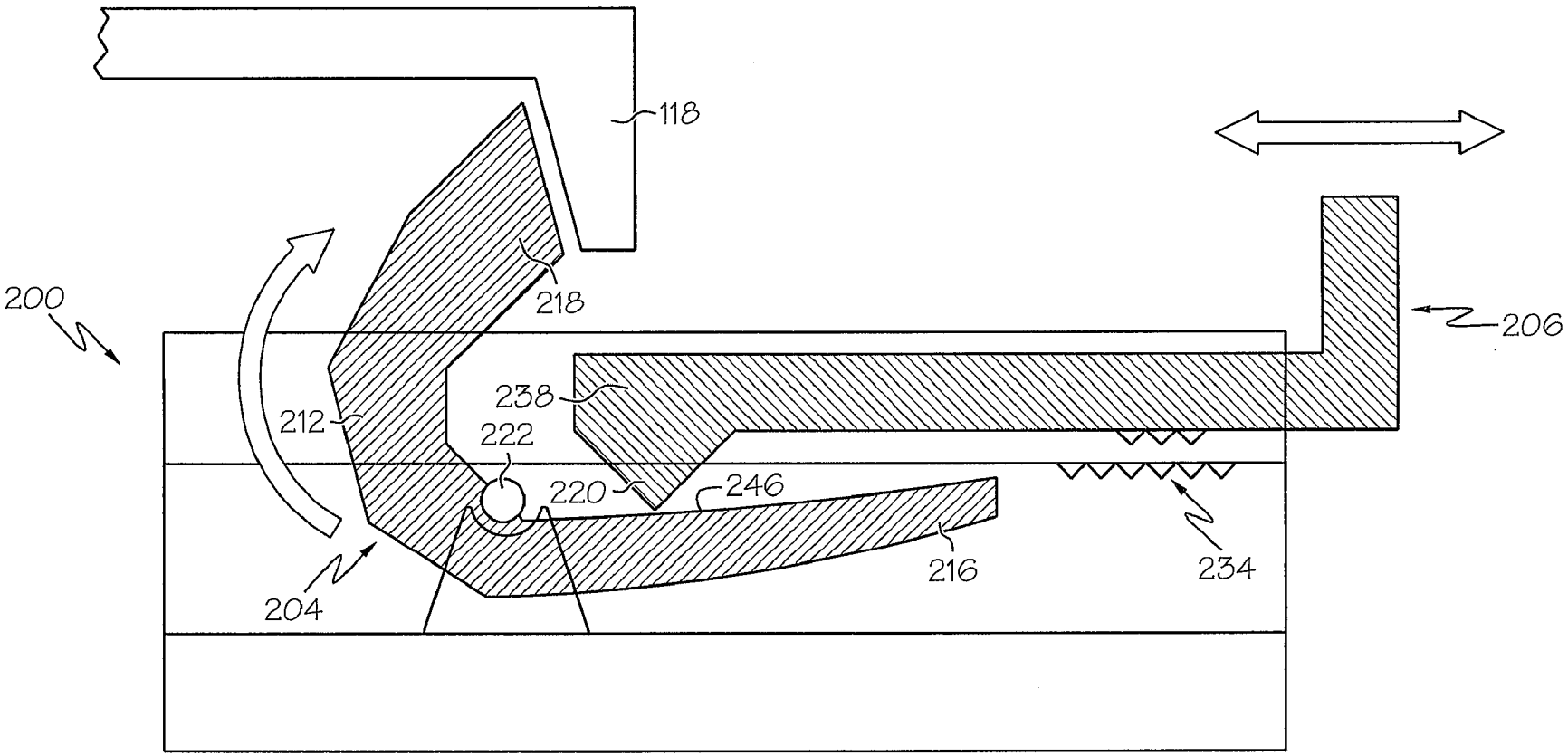

Within the completed (cover 224 is snapped to base 226) housing 202 is a pivot point 222, about which the middle section 212 of the U-shaped component 204 rotates. Pivot point 222 rests on a cradle base 232, which is fixed to the interior of housing 202. U-shaped component 204 has a first arm 214 and a second arm 216 that are connected to middle section 212. First arm 214 has a first arm end 218, which has a shape that is geometrically and functionally similar to the broken male RJ45 retention protrusion 116 shown in FIG. 1*b*, such that first arm end 218 is able to mate against a female RJ45 retention lip 118 in a like manner. In one embodiment, second arm 216 and a depressor end 238 (which has a depressor 220) of horizontal activator 206 are always within the completed housing 202 during operation (sliding operation of horizontal activator 206 described below) of replacement latch 200. An advantage for always having depressor end 238 (with depressor 220) and second arm 216 inside housing 202 is that only the horizontal linear movement of horizontal activator 206 can cause U-shaped component 204 to rotate, thus ensuring the fixed positioning of first arm end 218 against female RJ45 retention lip 118 (as shown in FIG. 2*c*). This is particularly true since linear latching grooves 234 on both an actuator surface 248 and a channel surface 236 hold a position of the horizontal activator 206, which can only overcome the frictional retention of the linear latching grooves 234 with firm manual pressure applied to a handle 242 on the handle end 240.

Referring now to FIG. 2*c*, functionality of replacement latch 200 is presented. By pushing horizontal activator 206 to the right, U-shaped component 204 rotates clockwise due to depressor 220 pressing against an inclined surface 246 of second arm 216. Note that pivot point 222 and inclined surface 246 must be adjusted such that pulling the depressor 220 to the right will cause this clockwise movement of U-shaped component 204. By thus rotating the U-shaped component 204 in a clockwise manner, first arm end 218 engages against the retention lip 118 of a female RJ45 receptacle in which a male RJ45 plug (to which the replacement latch 200 is attached) is inserted. Thus, the male RJ45 plug is securely mated within the female RJ45 receptacle. To remove the male RJ45 plug from the female RJ45 receptacle, the horizontal activator 206 is pushed to the left, thus causing the depressor end 238 to push against middle end 212 of the U-shaped component 204. This causes the U-shaped component 204 to rotate in a counter-clockwise manner about the pivot point 222, causing the first arm end 218 to disengage away from the retention lip 118.

While the present invention has been particularly shown and described with reference to a preferred embodiment, it will be understood by those skilled in the art that various changes in form and detail may be made therein without departing from the spirit and scope of the invention. For example, while terms such as "horizontal" and "clockwise" are used to describe relative movement of components, such terms should not be considered to be limiting of the breadth and scope of the present invention. In addition, while the present invention has been discussed in the context of replacing a latch on an RJ45 connector, it is equally useful with an RJ11 male connector. Thus, the term "RJxx" is defined to include both RJ45 and RJ11 connectors. Furthermore, as used in the specification and the appended claims, the term "computer" or "system" or "computer system" or "computing device" includes any data processing system including, but not limited to, personal computers, servers, workstations, network computers, main frame computers, routers, switches, Personal Digital Assistants (PDA's), telephones, and any other system capable of processing, transmitting, receiving, capturing and/or storing data.

What is claimed is:

1. A replacement latch for a male RJxx plug that has a broken latch, the replacement latch comprising:

a housing; and a latch within the housing, wherein the latch includes:

a substantially U-shaped component having a middle section that joins a first arm of the U-shaped component to a second arm of the U-shaped component, wherein the first arm terminates at a first arm end that has a shape that is geometrically similar to a standard RJxx retention protrusion, and wherein the middle section is rotatable about a pivot point that is inside the housing, and a horizontal activator having a depressor that is in sliding contact with the second arm, wherein a horizontal movement, in a first direction, of the horizontal activator causes the depressor to push against an inclined surface of the second arm, such that the middle section rotates about the pivot point to cause the first arm end to engage against a retention lip in a female RJxx receptacle.

2. The replacement latch of claim 1, further comprising:

latching grooves on both an actuator channel surface in the housing and an activator surface on the horizontal activator, wherein the latching grooves provide frictional retention against the horizontal activator to keep the first arm end engaged against the retention lip in the female RJxx receptacle.

3. The replacement latch of claim 1, wherein the horizontal activator has a handle end that is always outside the housing, and wherein the horizontal activator has a depressor end that is always inside the housing, and wherein a horizontal movement, in a second direction that is opposite the first direction, of the horizontal activator causes the horizontal activator to push against the middle section of the U-shaped component, thus resulting in the first arm end disengaging away from the retention lip of the female RJxx receptacle.

4. A cable having that terminates in an RJxx male plug, wherein the RJxx male plug has a broken original molded flexible latch, the RJxx clip having a replacement latch that includes:

a housing; and a latch within the housing, wherein the latch includes:

a substantially U-shaped component having a middle section that joins a first arm of the U-shaped component to a second arm of the U-shaped component, wherein the first arm terminates at a first arm end that has a shape that is geometrically similar to a standard RJxx retention protrusion, and wherein the middle section is rotatable about a pivot point that is inside the housing, and a horizontal activator having a depressor that is in sliding contact with the second arm, wherein a horizontal movement, in a first direction, of the horizontal activator causes the depressor to push against an inclined surface of the second arm, such that the middle section rotates about the pivot point to cause the first arm end to engage against a retention lip in a female RJxx receptacle.

5. The cable of claim 4, wherein the replacement latch further comprises:

latching grooves on both an actuator channel surface in the housing and an activator surface on the horizontal activator, wherein the latching grooves provide frictional retention against the horizontal activator to keep the first arm end engaged against the retention lip in the female RJxx receptacle.

6. The cable of claim 4, wherein the horizontal activator has a handle end that is always outside the housing, and wherein the horizontal activator has a depressor end that is always inside the housing, and wherein a horizontal movement, in a second direction that is opposite the first direction, of the horizontal activator causes the horizontal activator to push against the middle section of the U-shaped component, thus resulting in the first arm end disengaging away from the retention lip of the female RJxx receptacle.

7. A Local Area Network (LAN), wherein the LAN is coupled to computers via female RJxx receptacles and male RJxx plugs, and wherein at least one of the RJxx plugs has a broken original molded flexible latch, and wherein the RJxx clip has a replacement latch that includes:

a housing; and a latch within the housing, wherein the latch includes:

a substantially U-shaped component having a middle section that joins a first arm of the U-shaped component to a second arm of the U-shaped component, wherein the first arm terminates at a first arm end that has a shape that is geometrically similar to a standard RJxx retention protrusion, and wherein the middle section is rotatable about a pivot point that is inside the housing, and a horizontal activator having a depressor that is in sliding contact with the second arm, wherein a horizontal movement, in a first direction, of the horizontal activator causes the depressor to push against an inclined surface of the second arm, such that the middle section rotates about the pivot point to cause the first arm end to engage against a retention lip in a female RJxx receptacle.

8. The LAN of claim 7, wherein the replacement latch further comprises:

latching grooves on both an actuator channel surface in the housing and an activator surface on the horizontal activator, wherein the latching grooves provide frictional retention against the horizontal activator to keep the first arm end engaged against the retention lip in the female RJxx receptacle.

9. The LAN of claim 7, wherein the horizontal activator has a handle end that is always outside the housing, and wherein the horizontal activator has a depressor end that is always inside the housing, and wherein a horizontal movement, in a second direction that is opposite the first direction, of the horizontal activator causes the horizontal activator to push against the middle section of the U-shaped component, thus resulting in the first arm end disengaging away from the retention lip of the female RJxx receptacle.

* * * * *